US006318322B1

(12) United States Patent
Speil

(10) Patent No.: US 6,318,322 B1
(45) Date of Patent: Nov. 20, 2001

(54) VALVE DRIVE OF AN INTERNAL COMBUSTION ENGINE

(75) Inventor: Walter Speil, Ingolstadt (DE)

(73) Assignee: Ina Walzlager Schaeffler OHG, Herzogenaurach (DE)

( * ) Notice: Subject to any disclaimer, the term of this patent is extended or adjusted under 35 U.S.C. 154(b) by 0 days.

(21) Appl. No.: 09/673,684

(22) PCT Filed: Apr. 1, 1999

(86) PCT No.: PCT/EP99/02373

§ 371 Date: Oct. 19, 2000

§ 102(e) Date: Oct. 19, 2000

(87) PCT Pub. No.: WO99/56006

PCT Pub. Date: Nov. 4, 1999

(30) Foreign Application Priority Data

Apr. 23, 1998 (DE) ..... 198 18 146

(51) Int. Cl.[7] ..... F01L 1/24; F01L 1/18

(52) U.S. Cl. ..... 123/90.43; 123/90.57

(58) Field of Search ..... 123/90.15, 90.16, 123/90.39, 90.41, 90.42, 90.43, 90.46, 90.48, 90.55, 90.57

(56) References Cited

U.S. PATENT DOCUMENTS

| | | | |
|---|---|---|---|
| 4,469,061 | 9/1984 | Ajiki et al. | 123/198 F |
| 4,509,467 | 4/1985 | Arai et al. | 123/90.16 |
| 4,522,169 | 6/1985 | Arai et al. | 123/90.16 |
| 4,546,734 * | 10/1985 | Kodama | 123/90.16 |
| 4,615,307 | 10/1986 | Kodama et al. | 123/90.16 |

FOREIGN PATENT DOCUMENTS

| | | |
|---|---|---|
| 4111610A1 | 1/1992 | (DE) . |
| 4211631A1 | 4/1993 | (DE) . |
| 19509052A1 | 2/1996 | (DE) . |
| 19653459A1 | 6/1998 | (DE) . |
| 2006373A | 5/1979 | (GB) . |
| 6062616A | 4/1985 | (JP) . |

* cited by examiner

*Primary Examiner*—Weilun Lo
(74) *Attorney, Agent, or Firm*—Volpe & Koenig, P.C.

(57) ABSTRACT

A valve drive (1) including of a hydraulic support element (2), a finger lever (18) supported on the support element (2), and a cam (25) of a camshaft (26), is provided with opening mechanisms (27, 28, 29) for the forcible opening of a check valve (14) of the support element (2) during contact of a base circle (α) of the cam on the finger lever (18). The opening mechanisms (27, 28, 29) are formed from a slide extending in a support element, which acts on a closing body (13) of the check valve (14). In addition, they include a separate lever for the slide, where this lever communicates with a signal path on the camshaft (26). By these measures, eccentricity of the base circle (α) or the like no longer lead during a play compensation phase of the support element (2) to an undesired hardening of a high pressure chamber (12) of the support element (2).

11 Claims, 1 Drawing Sheet

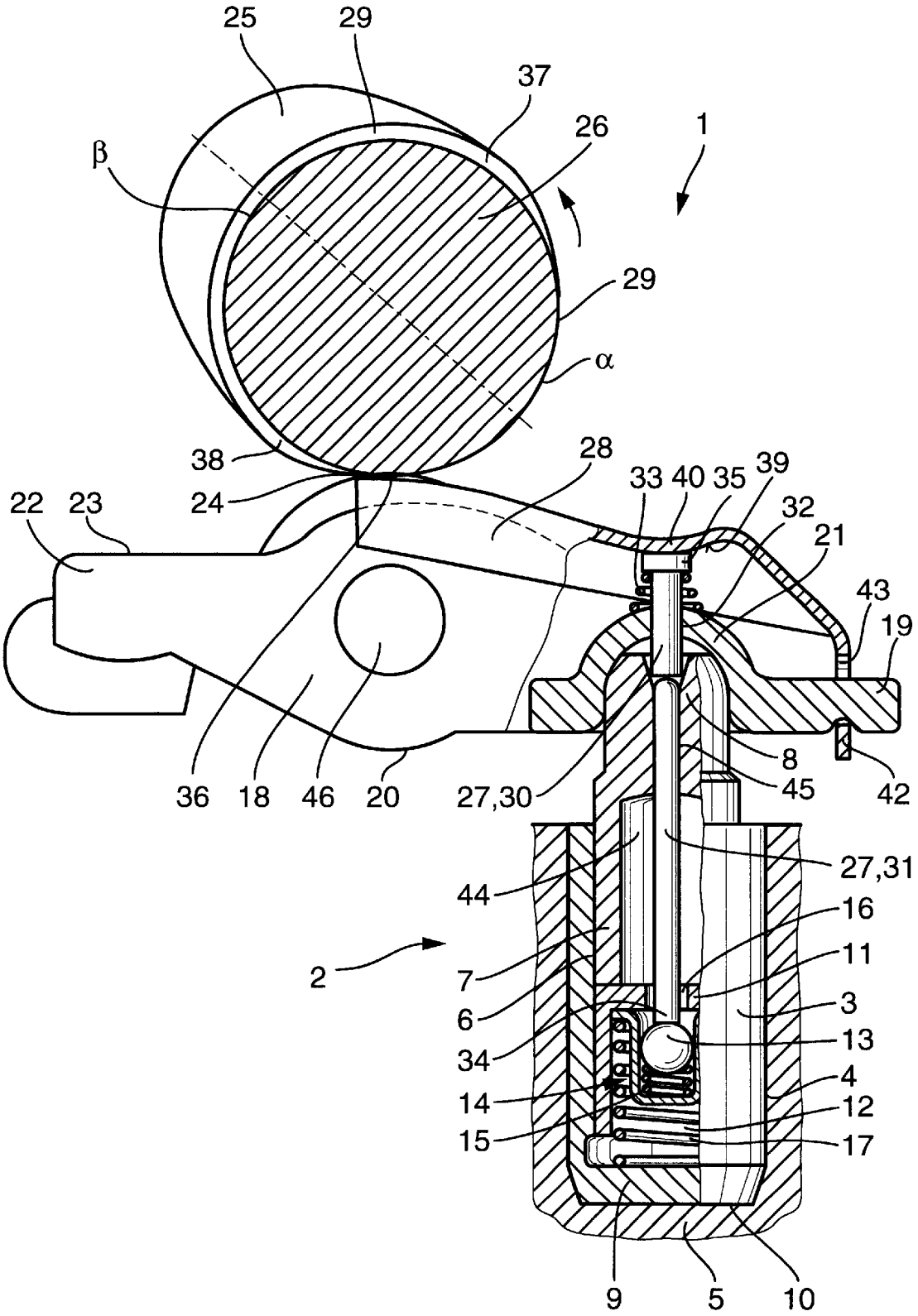
25
29
37
26
1
β
29
α
38
28
24
33 40 35 39
22 23
32
21
43
19
8
45
42
36 18 46 20
27,30
27,31
44
16
2
11
7
3
6
13
34
4
14
12
15
17
9
5
10

VALVE DRIVE OF AN INTERNAL COMBUSTION ENGINE

BACKGROUND

The invention relative to a valve drive of an internal combustion engine with the following characteristics:

a) the valve drive includes of a hydraulic support element, a finger lever and a cam of a camshaft or a plurality of these structural parts;

b) the support element is installed with its housing into a cam-side bore of a cylinder head, whereby a pressure piston that is axially movable relative to the housing and located in a bore of the housing projects with its head beyond the cylinder head in the direction of the cam, whereby between a bore-side bottom of the housing and a bore-side web of the pressure piston, a high pressure chamber for a hydraulic medium is located, which high-pressure chamber can be closed by a closing body of a check valve attached to the web in the direction toward a supply chamber or a supply line enclosed by the pressure piston;

c) the finger lever is constructed like a beam and has lateral surfaces near the cam and away from the cam, whereby it acts via a first end of the lateral surface away from the cam on at least one gas exchange valve in the direction of the stroke and is supported via a second end of the lateral surface away from the cam on the head of the pressure piston so that it can move by pivoting;

d) the cam acts on a contact section that lies between the ends of the cam-side lateral surface of the finger lever.

A valve drive of this type is known from the prior art from the document "Hydraulic Valve Lash Adjustment" (page 9) from August 1996, published by the applicant. It is disadvantageous in this that eccentricity of the cam base circle, transverse oscillations of the camshaft, brought on for example by auxiliary cams for injection pumps, or camshaft bearing play in the base circle can cause the high pressure chamber of the hydraulic support element to become hardened and the gas exchange valve opens in a most unfavorable way. Even in so-called transient operation of the engine, in particular during extremely cold environmental temperatures, the fall rate of the hydraulic support element is not sufficient to compensate for the positive dilatations on the gas exchange valve involved, preferably the outlet valve. In addition, in hydraulic support elements that have been constructed until now, a closing structure of its check valve must be opened with motor oil pressure. Thus, a certain time delay until the completion of the play compensation must be taken into account. This delay is a function of the instantaneous differential pressure incident on the check valve.

The object of the invention is thus to create a valve drive of the above-mentioned type, in which the cited disadvantages are eliminated.

SUMMARY OF THE INVENTION

According to the invention, this object is achieved in that the valve drive is provided with opening mechanisms for the positive or compulsory opening of the check valve of the support element during contact of a base circle of the cam on the lever.

By these measures and in particular in combination with the mechanisms disclosed, the disadvantages cited at the beginning are effectively eliminated.

By the fact that positive opening is done in the base circle of the closing body of the check valve via the slide, the high pressure chamber is no longer hardened when the operating conditions described above occur. During the defined base circle window, an unhindered overflow by hydraulic agent from the high pressure chamber into the supply chamber (or the supply line), and vice-versa, is enabled. It is also successful to design the spring element for the closing body of the check valve so that it is clearly stronger in its force than spring elements designed previously for support elements until now. This improves the dynamic behavior of the support element.

The opening mechanisms are preferably formed out of the aforementioned slide for the closing body, which can be impinged by a separate lever. This lever in turn communicates with at least one signal path provided on the cam. In particular, the signal path is positioned as a component of the opening mechanism on the cam axially adjacent to it and is designed with an approximately circular shape. In this manner, preferably on both sides, edge areas of the base circle of the cam and preferably, but not necessarily, the remaining path section outside of the base circle (cam catch flank, cam peak, cam drop flank) can be set at a lower radius than the base circle window. Thus, the slide is moved over the signal path that is raised in the base circle, which acts on the separate lever, moving it in such a way in the bore direction of the support element that the closing structure is opened forcibly and prevented from closing.

Edge areas of the base circle, which border on the cam catch flank and cam drop flank, are therefore designed lowered in radius so that the fill valve lift is available when the closing body for the gas exchange valve is closed. Otherwise, the loss in lift must be compensated by an increased cam contour.

In a preferred embodiment, a two-piece slide is proposed, which preferably has a rod-like construction. Also conceivable, however, are other geometries and/or also non-axially running slides, but rather these types of mechanisms acting radially or slanted on the closing body. Likewise, triggered external impingement mechanisms such as electromagnets and the like can be used to dislocate the closing body during the base circle phase.

According to an advantageous embodiment of the invention, the separate lever should be attached on the second end of the finger lever. A simple attachment form is created in that the lever has in the section of the end, a bent projection which has a clip. Using this clip, it can be attached in a simple way to the second end of the finger lever. As an alternative to this, it is also contemplated to insert a joint as a bearing for the second lever and/or to arrange the second lever separately relative to the cylinder head or an additional structural part arranged in the cylinder head.

A measure favorable in terms of wear is provided in an additional subordinate claim. According to the measure, the separate lever should be expanded in its contact area to the signal path or to the slide or provided with suitable wear protection measures such as a heat treatment. In this way, the life of the lever is clearly improved or its wear is reduced. If possible, this separate lever, as well as the finger lever as such, can be dimensioned so that it is thin-walled or made from a light construction material.

A first part of the proposed two-piece slide runs advantageously in the second end of the finger lever, whereby the finger lever has as a rest for the head of the pressure piston of the support element, a dome-shaped recess. The first part is spring-loaded in the cam direction via a spring element, such as a compression spring. Thus, in the unloaded state of the signal path, the first part is removed via the spring element from the area of the dome-shaped recess. In this way, the first part can no longer come into contact with the head of the pressure piston when the finger lever is pivoted. At the same time, the second part of the slide, which is adjacent to the first part, is made so that its length is such that it also does not project into the area of the dome-shaped recess when it is unloaded, so that it has a contact to the base of this recess.

In a further embodiment of the invention, it is proposed to guide the second part of the slide over a head of the pressure piston, which is constructed so that it is solid, for example, where the pressure piston then has a longitudinal bore. It can be provided, however, also, to arrange inside the pressure piston, preferably in this supply chamber, a separate washer or a similarly suitable mechanism, over which the second part is additionally conducted. Should the pressure piston not be constructed so that it is solid, but instead, for example, from a sheet metal material, then in the head area, separate sheaths or similarly used elements can be applied. Also, it is conceivable to guide the first part via support plates or the like which emerge from the sides of the finger lever and extend in the cam direction and then are bent in the direction of the second part.

It is proposed to construct the check valve as a ball valve. This valve can be manufactured in a cost-effective way or obtained as a mass production part. As mentioned, the spring element, which impinges the closing body of the check valve in the closing direction, can be designed so that it has a relatively strong spring force. In this way, an immediate closing of the overflow bore is to be taken into account at the desired point in time; i.e. prior to the beginning of the cam catch flank. It is also conceivable, however, to have a plate valve or a similar solution.

An additional measure for reducing the friction is proposed in that the contact section of the finger lever is manufactured as a roller, which can be constructed selectively so that it is set in roller bearings opposite the finger lever.

It is also conceivable to position the separate lever on both sides of the finger lever in a fork-like manner, such that transverse moments can no longer act on it. It is advantageous to arrange the signal path also on both sides of the cam. Also, it is provided to reverse the impingement form of the slide. According to this, the slide can be impinged via a spring force in the unloading direction of the check valve, and pulled back via the control contour that acts on the separate lever.

In addition it is proposed to couple at least one of the parts of the slide along the length in the valve drive. In this way, a tolerance of a lift of the closing structure can be adjusted to be relatively small.

The measures according to the invention also provide the advantage that an excellent ventilation of the high pressure chamber is achieved. In this way, additional ventilation measures can be omitted and the entire construction height of the support element can be clearly minimized. Possibly, a supply room is no longer necessary for the hydraulic medium. In this way, in turn, the length of the slide can be minimized. The high pressure chamber itself defines only a small volume and the additional axial stoppers for the pressure piston, until now made on the housing, can be omitted.

BRIEF DESCRIPTION OF THE DRAWING

The invention is explained in greater detail functionally using the drawing.

The only drawing shows a cross-section through the valve drive according to the invention.

DETAILED DESCRIPTION OF THE PREFERRED EMBODIMENT

The drawing shows a valve drive 1, whose basic construction is known to the skilled artisan from the design. This valve drive 1 includes of a hydraulic support element 2, which is installed with its housing 3 in a bore 4 of a cylinder head 5. In a bore 6 of the housing 3, a pressure piston 7 is integrated that is axially movable relative to the housing. This pressure piston 7 includes a head 8 that projects beyond the bore 4.

A bottom 9 of the housing 3 extends at least indirectly opposite a base 10 of the bore 4. At the same time, the pressure piston 7 has on the bore side a radially inwardly extending web 11. Between the web 11 and the bottom 9, a high pressure chamber 12 is made for a hydraulic medium. At the same time, on the web 11, a closing body 13 of a check valve 14 is attached. This closing body 13 is constructed as a ball and is impinged in the closing direction by a spring element 15, here manufactured as a compression spring. The closing body 13 closes an overflow bore 16 positioned in the web 11. At the same time, the pressure piston 7 is impinged in a direction away from the bore 4 by an additional spring element 17.

On the head 8 of the pressure piston 7, a finger lever 18 is supported in the area of its second end 19. For this purpose, the finger lever has on its lateral surface 20 that is away from the cam, a dome-shaped recess 21. The head 8 in turn has at least in its contact area to the recess 21, a complementary form.

In the area of its first end that is located on the lateral surface 20 away from the cam, the finger lever 18 acts on at least one gas exchange valve (not shown) in the stroke direction.

A cam-side lateral surface 23 of the finger lever 18 has, between the first and the second ends 22, 19, a contact section 24 for a cam 25 of a camshaft 26. This contact section 24 is constructed as a roller, which will not be explained further here, which runs on an axle 46 arranged perpendicularly in the finger lever 18.

According to the invention, the valve drive 1 is provided with opening mechanisms 27, 28, 29. These cause a forcible opening of the check valve 14 during contact of a base circle $\alpha$ of the cam 25 on the finger lever 18. The opening means 27 is manufactured as a slide with a rod-type construction and runs preferably axially in the pressure piston 7. Preferably, the opening means 27includes a first part 30 and a second part 31. The first part 30 is arranged in a receptacle 32 that extends through the recess 21 and is impinged by an spring element 33, such as a compression spring, in the cam direction. The first part 30 borders the second part 31. This second part 31 is guided directly in the pressure piston 7 and acts with its other end 34 in the opening direction directly on the closing body 13.

A first end 35 of the first part 30 is impinged by an additional component of the opening mechanism. This is constructed here as a separate lever 28. The lever 28 has on one end a contact area 36, by which it communicates with a third component of the opening mechanism. This third component is formed as a signal path 29 for the separate lever 28. The signal path 29 extends preferably axially adjacent to the cam 25 on the camshaft 26 and has in principle a circular geometry. However, it has an area with a reduced radius on the edge areas 37, 38 on both sides of the base circle α as seen in the rotation direction, and over the remaining circumferential section β. The circumferential section β extends over the cam height; i.e. the cam catch flank, the cam peak and the cam drop flank.

At the same time, it can be ascertained from the drawing that the separate lever 28 has approximately in the area of its center on a side 39 facing away from the cam, a contact area 40 for the first end 35 of the first part 30 of the slide 27. In the area of the second end 19, the separate lever 28 makes a transition into a bent catch 42. This catch has a clip 43, by which it is attached on the second end 19 of the finger lever 18 so that it can pivot.

As can be ascertained from the drawing, the signal path 29 impinges the separate lever 28 in the base circle α in such a way that the slide 27 with its parts 30, 31 is translated axially in the direction to the support element 2. In this way, the closing body 13 is moved in the direction into the high pressure chamber 12, such that the overflow bore 16 is forcibly opened. Thus, during the aforementioned base circle phase, an unobstructed and forcible overflow of hydraulic agent out of the high pressure chamber 12 into a supply space 44 enclosed by the pressure piston 7 or in a supply line (not shown) and in reverse, is made possible. Disadvantageous transverse oscillations of the camshaft 26 or eccentricity in the base circle α of the cam 25 and the like, as in the prior known state of the art can no longer lead to the undesired hardening of the high pressure chamber 12 and possibly cause unloading or opening of the impinged gas exchange valve during the base circle phase. In the rotational direction of the cam 26, the edge area 38 of the signal path 29 extends from to the base circle α as a component of the base circle α. This edge area 38 and the other circumferential section β and the following edge area 37 (which in turn transitions to the beginning base circle α) are reduced in their radius opposite the radius of the base circle α, in a quasi-groove shape. In this manner, a depth for the circumferential section β with edge areas 37, 38 is selected so that the separate lever 28 is unloaded via the force of the spring element 33, 15 as far in the direction of the cam so that the closing body 13 can exert its closing function. If necessary, the separate lever 28 can be supported in its movement in the cam direction by elastic means (not shown in greater detail).

Reference Number List

1 Valve drive
2 Support element
3 Housing
4 Bore
5 Cylinder head
6 Bore
7 Pressure piston
8 Head
9 Bottom
10 Base
11 Web
12 High pressure chamber
13 Closing body
14 Check valve
15 Spring element
16 Overflow bore
17 Spring element
18 Finger lever
19 Second end
20 Lateral surface away from cam
21 Dome-shaped recess
22 First end
23 Cam-side lateral surface
α Base circle
β Circumference section
24 Contact section
25 Cam
26 Camshaft
27 Opening mechanism, slide
28 Opening mechanism, separate lever
29 Opening mechanism, signal path
30 First part
31. Second part
32. Receptacle
33. Spring element
34. Other end
35. First end
36. Contact area
37. Edge area
38. Edge area
39. Facing side away from cam
40. Contact area
41. not given
42. Catch
43. Clip
44. Supply chamber
45. Guide bore
46. Axis

What is claimed is:

1. Valve drive (1) of an internal combustion engine including the following:

the valve drive (1) includes a hydraulic support element (2), a finger lever (18) and a cam (25) of a camshaft (26) or a plurality of these structural parts;

the support element (2) includes a housing (3) that is installed into a cam-side bore (4) of a cylinder head (5), so that a pressure piston (7) that is axially movable relative to the housing (3) and located in a bore (6) of the housing (3) projects with its head (8) beyond the cylinder head (5) in the direction of the cam, whereby between a bore-side bottom (9) of the housing (3) and a bore-side web (11) of the pressure piston (7), a high pressure chamber (12) for hydraulic medium is formed, where the high-pressure chamber (12) being closeable by a closing body (13) of a check valve (14) attached to the web (11) in the direction toward a supply chamber (44) or a supply line enclosed by the pressure piston (7);

the finger lever (18) is constructed as a beam and includes lateral surfaces (23, 20) near the cam and away from the cam, whereby it acts via a first end (22) of the lateral surface (20) away from the cam on at least one gas exchange valve in a direction of stroke and is supported via a second end (19) of the lateral surface (20) away from the cam on the head (8) of the pressure piston (7) so that it can move by pivoting;

the cam (25) acts on a contact section (24) that lies between the ends (22, 19) of the cam-side lateral surface (23) of the finger lever (18); characterized in that the valve drive (1) is provided with means for compulsory opening of the check valve (14) of the support element (2) during contact of a base circle (α) of the cam (25) on the finger lever (18), comprising a slide (27), a separate lever (28) and a signal path (29) located on the cam (25), whereby the slide (27) is arranged in the support element (2) and includes a first end (35) that projects axially beyond the head (8) and with another end (34) impinges the closing body (13) of the check valve (14), the first end (35) contacts the separate lever (28), which contacts the signal path (29) on one end and on the other end, is pivotably attached to the second end (19) of the finger lever (18) or the cylinder head (5).

2. Valve drive according to claim 1, characterized in that, the signal path (29) is arranged axially adjacent to the cam (25) on the camshaft (26) and includes outside the base circle ($\alpha$) of the cam (25), at least in edge areas (38, 37) on both sides of the base circle ($\alpha$) on its cam catch flank and cam drop flank, a circumferential section ($\beta$) that is reduced in radius.

3. Valve drive according to claim 1, characterized in that, the separate lever (28) makes a transition in the area of the second end (19) of the finger lever (18) into a catch (42) that extends approximately perpendicular to a longitudinal extension direction of the lever (28) and is connected via a clip (43) or a joint to the second end (19).

4. Valve drive according to claim 1, characterized in that, the separate lever (28) is expanded in a contact area (36, 40) to the signal path (29) or to the slide (27) or provided with suitable wear protection measures including a heat treatment or an applied layer.

5. Valve drive according to claim 1, characterized in that, the finger lever (18) or the separate lever (28) is made out of a sheet metal material or a light construction material.

6. Valve drive according to claim 1, characterized in that, the slide (27) is made in two pieces, wherein a first part (30) extends into the second end (19) of the finger lever (18) and is impinged by the separate lever (28), and wherein a second part (31) is arranged in the pressure piston (7) and communicates with the closing body (13) of the check valve (14), with both parts (30, 31) being adjacent to each other.

7. Valve drive according to claim 6, characterized in that, the second end (19) of the finger lever (18) has a dome-shaped recess (21) in which the head (8) of the pressure piston (7) is seated, whereby the first part (30) of the slide (27) is spring-loaded via an spring element (33) in the cam direction, so that when it is uncompressed the separate lever (28) is outside of a contact area from the head (8) of the pressure piston (7), and whereby the second part (31) of the slide (27) is made a sufficient length so that it is out of contact with the recess (21) when it is uncompressed by the separate lever (28).

8. Valve drive according to claim 1, characterized in that, the check valve (14) is constructed as a ball valve, whereby the ball is impinged in the closing direction by a spring element (15).

9. Valve drive according to claim 1, characterized in that, the head (8) of the pressure piston (7) is solid with a guide bore (45) for the slide (27).

10. Valve drive according to claim 1, characterized in that, the contact section (24) of the finger lever (18) is made as a roller, which runs on a roller bearing on an axle (46) arranged in the finger lever (18).

11. Valve drive according to claim 6, characterized in that, at least one of the parts (30, 31) of the slide (27) is coupled lengthwise in the valve drive (1).

* * * * *